US010782030B2

(12) United States Patent
Gargiulo et al.

(10) Patent No.: US 10,782,030 B2
(45) Date of Patent: Sep. 22, 2020

(54) COOKTOPS WITH INTEGRATED HOODS

(71) Applicant: Elica S.p.A., Fabriano (AN) (IT)

(72) Inventors: Antonello Gargiulo, Fabriano (IT); Gennaro Buonomo, Fabriano (IT); Sandrino Roscini, Fabriano (IT)

(73) Assignee: ELICA S.P.A., Fabriano (AN) (IT)

( * ) Notice: Subject to any disclaimer, the term of this patent is extended or adjusted under 35 U.S.C. 154(b) by 11 days.

(21) Appl. No.: 16/091,008

(22) PCT Filed: Mar. 23, 2017

(86) PCT No.: PCT/IB2017/051685
§ 371 (c)(1),
(2) Date: Oct. 3, 2018

(87) PCT Pub. No.: WO2017/175085
PCT Pub. Date: Oct. 12, 2017

(65) Prior Publication Data

US 2019/0032925 A1 Jan. 31, 2019

(30) Foreign Application Priority Data

Apr. 5, 2016 (IT) ..... 102016000034820

(51) Int. Cl.
*F24C 15/20* (2006.01)
*F04D 17/16* (2006.01)

(52) U.S. Cl.
CPC ..... *F24C 15/2042* (2013.01); *F04D 17/162* (2013.01); *F24C 15/2035* (2013.01); *F24C 15/2071* (2013.01)

(58) Field of Classification Search
CPC ..... F24C 15/2042; F24C 15/2035; F24C 15/2071; F24C 15/20; A47B 2200/06; F04D 17/162; B08B 15/007; F24F 7/065
See application file for complete search history.

(56) References Cited

U.S. PATENT DOCUMENTS 2,029,368 A * 2/1936 Goldthwaite ..... F24F 6/04 236/12.17
2,674,991 A 4/1954 Schaefer
(Continued)

FOREIGN PATENT DOCUMENTS

DE G 90 16 767.8 U1 2/1991
DE 10 2013 204 144 A1 9/2014
(Continued)

OTHER PUBLICATIONS

International Search Report and Written Opinion dated Jun. 19, 2017, in PCT Application No. PCT/IB2017/051685, 11 pages.

*Primary Examiner* — Jorge A Pereiro
(74) *Attorney, Agent, or Firm* — MH2 Technology Law Group LLP

(57) ABSTRACT

A cooktop, defining top and bottom surfaces, may include: cooking zones and a cavity in the top surface; and a device for operating and controlling the cooktop and for permitting downward exhaust of cooking vapors. The device may include, in order from the top surface, an apparatus holding elements that heat the cooking zones and control and monitor electronics for the cooktop, a first cooking vapor intake chamber in fluid communication with the cavity, a fan housing for a radial fan, and a second cooking vapor intake chamber in fluid communication with the cavity. The fan housing may be in fluid communication with the first and second intake chambers. The first intake chamber may be configured to divide the cooking vapors into a first portion, to be conveyed downward into the fan housing, and a second portion, to be conveyed upward into the fan housing through the second intake chamber.

20 Claims, 5 Drawing Sheets

(56) References Cited

U.S. PATENT DOCUMENTS

| | | | | |
|---|---|---|---|---|
| 4,562,827 | A * | 1/1986 | Cerola | F24C 15/2042 126/299 R |
| 5,746,577 | A * | 5/1998 | Ito | F04D 17/162 416/178 |
| 6,345,956 | B1 * | 2/2002 | Lin | F04D 29/282 415/119 |
| 2007/0062513 | A1 | 3/2007 | Gagas | |
| 2009/0123285 | A1 | 5/2009 | Sinzaki | |
| 2014/0048057 | A1 | 2/2014 | Bruckbauer | |
| 2014/0079569 | A1 * | 3/2014 | Uehara | F04D 29/4226 417/312 |
| 2014/0233183 | A1 * | 8/2014 | Horng | G06F 1/203 361/692 |
| 2016/0177957 | A1 * | 6/2016 | Santucci | F04D 29/624 417/411 |
| 2016/0177972 | A1 * | 6/2016 | Santucci | F04D 29/281 417/423.14 |
| 2016/0178233 | A1 * | 6/2016 | Santucci | F04D 25/14 126/299 D |

FOREIGN PATENT DOCUMENTS

| | | | |
|---|---|---|---|
| EP | 1 236 908 | A2 | 9/2002 |
| WO | 2012/146237 | A1 | 11/2012 |
| WO | 2014/139780 | A1 | 9/2014 |

* cited by examiner

COOKTOPS WITH INTEGRATED HOODS

CROSS-REFERENCE TO RELATED APPLICATION(S)

This application is a national stage entry from International Application No. PCT/IB2017/051685, filed on Mar. 23, 2017, in the Receiving Office ("RO/IB") of the International Bureau of the World Intellectual Property Organization ("WIPO"), and published as International Publication No. WO 2017/175085 A1 on Oct. 12, 2017; International Application No. PCT/IB2017/051685 claims priority from Italian Patent Application No. 102016000034820, filed on Apr. 5, 2016, in the Italian Patent and Trademark Office ("IPTO"), the entire contents of all of which are incorporated herein by reference.

TECHNICAL FIELD

The present disclosure relates to a cooktop in accordance with the preamble of claim 1.

Particularly, but without limitation, the present disclosure relates to a cooktop integrating a hood that is commercially available under the name of "downdraft hood".

BACKGROUND OF THE INVENTION

Domestic hoods have become a common feature in residential kitchens, due to their undisputed usefulness in extracting food preparation gases, i.e. vapors generated during by cooking.

The provision of domestic hoods that can effectively remove cooking vapors generated during food preparation is of increasing importance.

For this purpose, hoods have been developed that can both extract air and exhaust the extracted air out of the house, using an intake section, and filter such air and recirculate it into the domestic environment.

Downdraft hoods are among the variety of commercially available hoods, and are often integrated either in a cooktop or in a kitchen furniture countertop.

Namely, a downdraft hood is configured to generate a crossflow that is higher than the ascending flow rate of cooking steam, so that such steam is extracted toward the cooktop in a vertical downward direction.

One example of these downdraft hoods is disclosed in U.S. Pat. No. 2,674,991, US 2007/0062513 or WO 2012/146237.

These documents disclose a cooktop with a hood integrated therein. The hoods disclosed therein are configured to extract gases through a cavity or slot formed in the cooktop, substantially close to the geometric center defined by the food heating zones.

While the cooktop implementations as disclosed in U.S. Pat. No. 2,674,991, US 2007/0062513 and WO 2012/146237 afford adequate function for their intended purposes, they still have a poorly efficient construction, in terms of both power and, especially, fluid dynamic efficiency.

Therefore, the technical purpose of the present disclosure is to provide a cooktop with an integrated hood that is generally more efficient than prior art designs.

SUMMARY OF THE INVENTION

According to the present disclosure, the above mentioned technical purpose and objects are fulfilled by a cooktop as defined in one or more of the claims annexed hereto.

Advantages

Furthermore, the present disclosure provides a cooktop with an integrated hood that has an improved power efficiency, i.e. consumes less power than prior art designs.

The present disclosure also provides a cooktop with an integrated hood that has a more efficient filtering effect on the extracted gases.

BRIEF DESCRIPTION OF THE DRAWINGS

Further features and advantages of the present disclosure will be more clearly apparent from the illustrative, non-limiting description of preferred, non-exclusive embodiments of a domestic hood as shown in the annexed drawings, in which.

DETAILED DESCRIPTION

Figure 1:
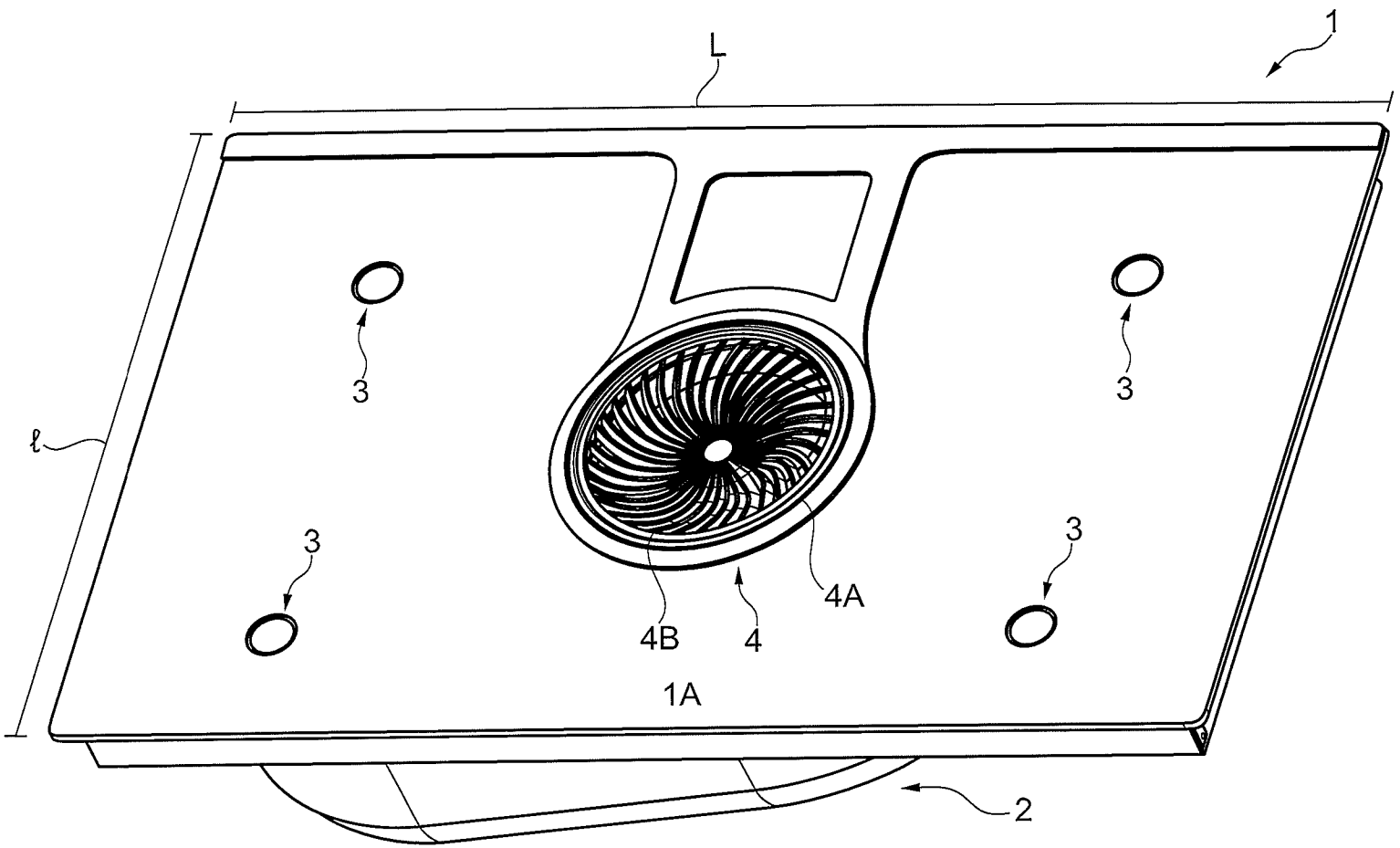
FIG. 1 shows a perspective top view of one embodiment of a cooktop of the present disclosure.
Figure 2:
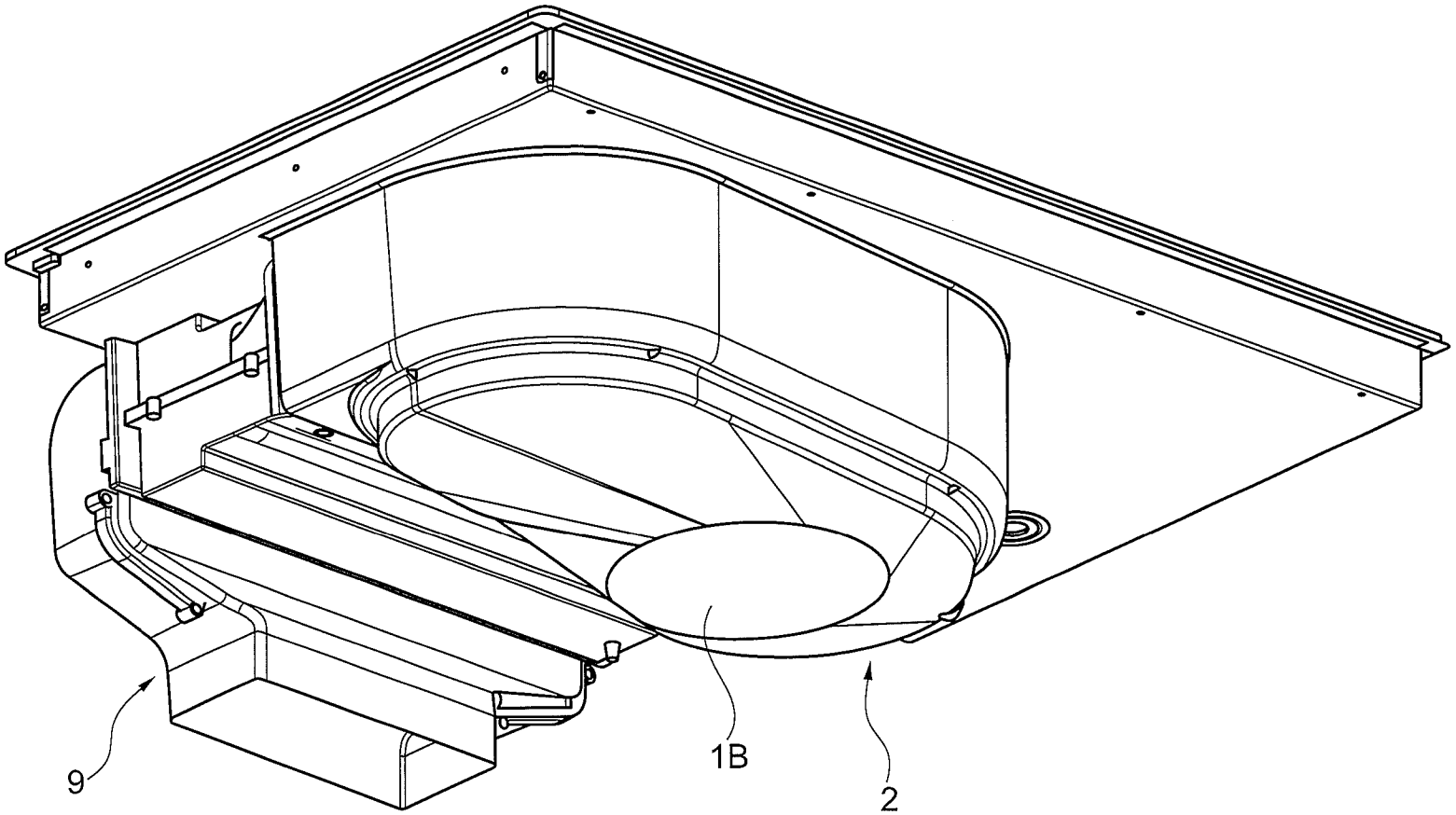
FIG. 2 shows a perspective bottom view of the hood of FIG. 1.

Even when this is not expressly stated, the individual features as described with reference to the particular embodiments shall be intended as auxiliary to and/or interchangeable with other features described with reference to other exemplary embodiments.

A cooktop of the present disclosure has been generally designated by numeral 1 in the figures.

The cooktop 1 has predetermined width "L", length "1" and height "H" and comprises, preferably within such height "H", a device 2 that accommodates the parts required for controlling and heating/cooking food, as well as for extracting cooking vapors F, as described below in greater detail.

Such cooktop 1 defines a top surface 1A and a bottom surface 1B.

Namely, when the cooktop 1 is installed, the top surface 1A is designed to be the exposed or visible side and the bottom surface 1B is designed to be the side that is hidden to the view of users, e.g. embedded in kitchen furniture.

In one aspect, a plurality of cooking zones 3 and a cavity 4 can be found in the top surface 1A.

The plurality of cooking zones 3 are conveniently arranged over the top surface 1A and are particularly able to radiate heat to transfer such heat to a container in which the food to be heated is held.

In a preferred embodiment, the cooking zones 3 are embodied as resistive or, more preferably, inductive heating elements.

While the plurality of cooking zones 3 are four zones in the exemplary embodiment of FIG. 1, other embodiments might envisage a greater or smaller number of zones.

In one embodiment, the top surface 1A is embodied as a glass sheet or a sheet made of any material having glass-like properties.

The cavity 4 substantially extends between the top surface 1A and the bottom surface 1B and is preferably located in a central area relative to the positions of the cooking zones 3.

In the particular embodiment of the figures, the cavity 4 extends from the top surface 1A and almost reaches the bottom surface 1B without touching it, i.e. leaves a space that, as described in greater detail below, is designed for collection of water, steam and/or fluids.

Figure 5:
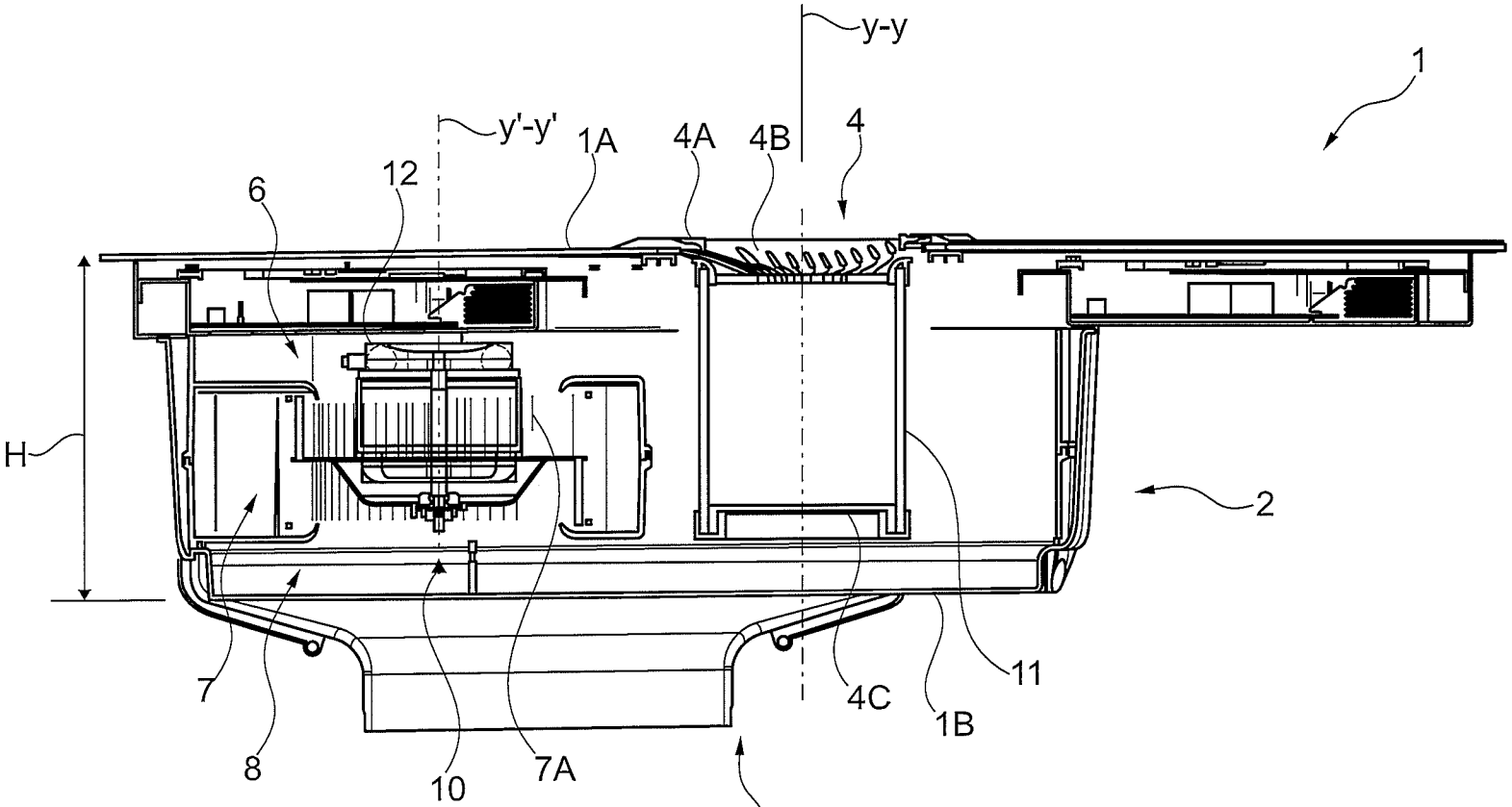
FIG. 5 shows a lateral sectional view of the hood of FIG. 1, with certain parts omitted to better show other parts.

Particularly, also as shown in FIG. 1, the cavity 4 forms an inlet port 4A, preferably having a circular shape, which is protected by a grille 4B, and a bottom 4C (see FIG. 5).

The cavity 4 has a cylindrical shape, which is open both on the lateral surface and on the base surface (i.e., the surface that forms the bottom 4C) for the cooking vapors F to be able to flow toward the first and second cooking vapor intake chambers 6 and 8, as described in greater detail below.

It shall be noted that the grille 4B is both removable from the inlet port 4A and has a safety purpose, as it prevents the introduction of elements that might interfere with the operation of the electric machine 12.

In one aspect, also referring to FIG. 5, the cooktop 1 comprises a filter 11 arranged in the cavity 4 to filter out grease and vapors in cooking gases.

Namely, such filter 11 is designed to create a form-fit with the cavity 4.

Preferably, the filter 11 is a grease filter consisting of metal mesh or other materials having similar characteristics.

In a preferred embodiment, the filter 11 has a cylindrical shape and can be pulled off the cavity 4 for the user to carry out normal maintenance operations, such as cleaning or replacement.

In one aspect, the device 2 forms a mounting unit with the cooktop 1, for operating the cooktop and allowing cooking vapors F to flow downwards, i.e. below the top surface 1A.

In other words, the device 2 is integrated with the top surface 1A, such that the extraction hood is integrated in the cooktop.

Namely, this device 2 is configured to convey the flow of cooking vapors F that has been and is being generated above the cooking zones 3 in a vertical downward direction below the cooktop itself.

Figure 3:
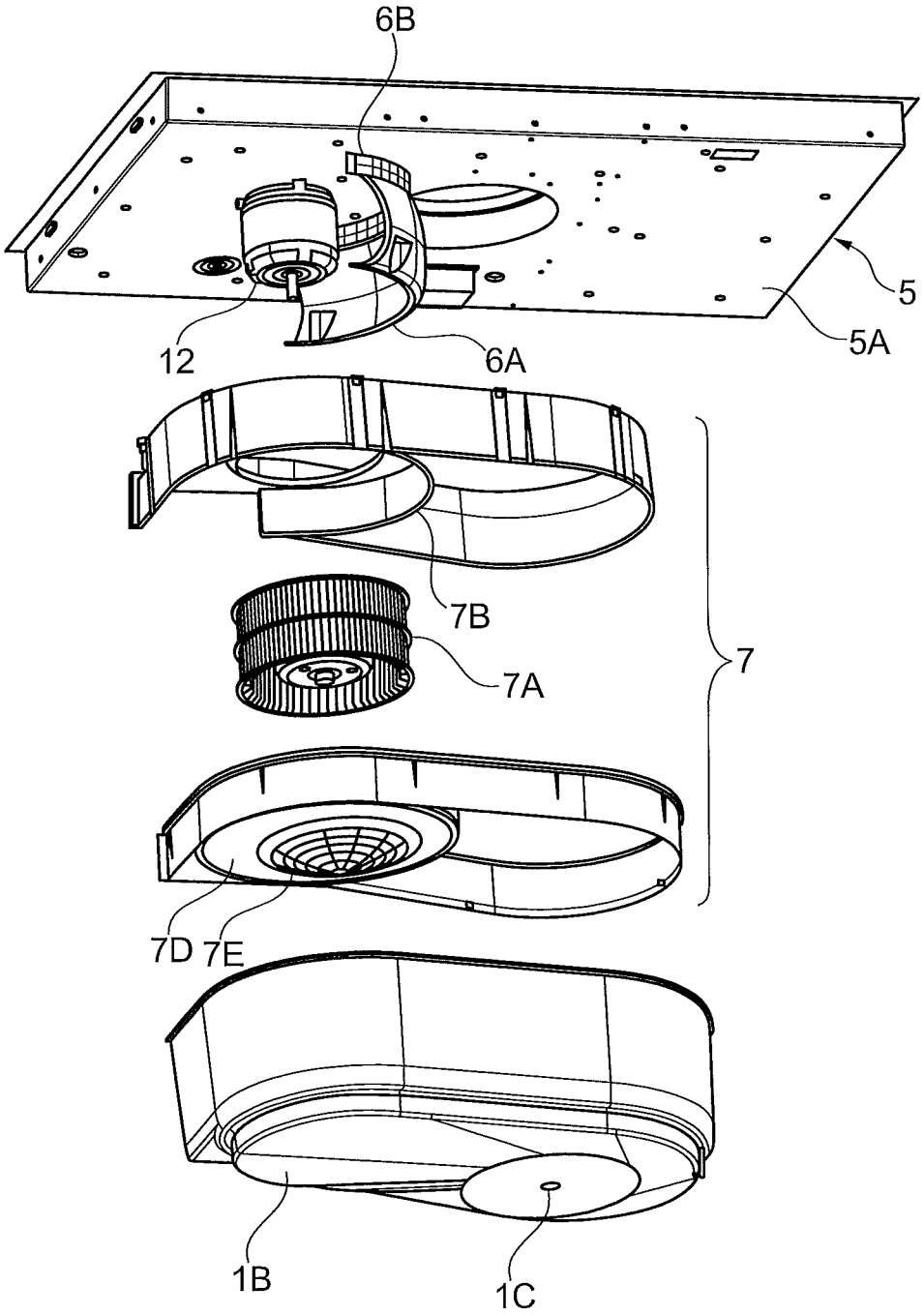
FIG. 3 is an exploded perspective view of the parts of the hood of FIG. 1.

In a peculiar aspect of the present disclosure, also referring to FIGS. 3 and 5, the device 2 comprises in succession, from the top surface 1A:

- an apparatus 5 operably configured to contain the heating elements required for heating the cooking zones 3 and the electronics for controlling the cooktop 1,
- a first cooking vapor intake chamber 6 in fluid communication with such cavity 4,
- a fan housing 7 for a radial fan 7A, and
- a second cooking vapor intake chamber 8 in fluid communication with such cavity 4.

It shall be noted that, as used herein, the term "in succession" designates the succession of the aforementioned elements in the specified order, in the direction from the top surface 1A toward the bottom surface 1B.

Advantageously, the fan housing 7 is in fluid communication with both the first cooking vapor intake chamber 6 and the second cooking vapor intake chamber 8.

In one aspect, the first cooking vapor intake chamber 6 is configured to divide the cooking vapors F into a first portion F1 of the cooking vapors F, to be conveyed downwards into the fan housing 7, and a second portion F2, to be conveyed upwards into the fan housing 7 through said second cooking vapor, intake chamber 8.

Therefore, due to the presence of the first cooking vapor intake chamber 6, the cooking vapors F are divided into first and second portions F1 and F2, which are conveyed with a less turbulent flow, i.e. a more laminar flow, toward the fan housing 7.

This separation of the cooking vapors F into the first and second portions F1 and F2 is particularly beneficial as compared with a single downward stream of cooking vapors flowing directed toward the fan housing 7, as disclosed in the prior art, as the first and second portions F1 and F2 have less vorticity and are less exposed to pressure losses.

Namely, in the present disclosure the cooking vapors F are separated into the first and second portions F1 and F2 by a perimeter wall 6A of the first cooking vapor intake chamber 6.

Such perimeter wall 6A acts as a conveyor of the cooking vapors F, and particularly acts as a partition for such cooking vapors F, which flow along the cavity 4 between the first and second cooking vapor intake chambers 6 and 8.

Such perimeter wall 6A particularly defines an outer surface, which faces the cavity 4, and an inner surface, which faces the first and second cooking vapor intake chambers 6 and 8, as well as the fan housing 7 for the radial fan 7A.

Due to the profile of the outer surface of the perimeter wall 6A, the cooking vapors F are divided into the first and second portions F1, F2 respectively and, due to the profile of the inner surface of the perimeter wall 6A, the first portion F1 and the second portion F2 are conveyed by laminar flow toward the fan housing 7.

Particularly, the curved shape of the perimeter wall 6A makes such first and second portions F1 and F2 more laminar as it facilitates and promotes their movement toward the fan housing 7.

In a preferred embodiment, the curved shape of the perimeter wall 6A has the shape of an arc of a parabola.

In one aspect, the first portion F1 flows through an intake grille 6B to access the first cooking vapor intake chamber 6 from the cavity to reach the fan housing 7 of the radial fan 7A, whereas the second portion F2 flows through an intake grill 7E to access the fan housing 7 of the radial fan 7A.

It shall be noted that the intake grilles 6B and 7E are the grilles required by regulations to protect user safety, by preventing users from directly reaching the radial fan 7A and the electrically powered parts.

It shall be further noted that the intake grille 6B not only acts as a protection element, but can also impart a more regular pattern to the first portion F1.

For this purpose, the intake grille 6B is placed proximate to the bottom 5A of the apparatus 5 housing the electronics.

Due to this position of the intake grille 6B relative to the bottom 5A of the apparatus 5, the first portion will be directed outwards, i.e. substantially parallel to the top surface of the cooktop 1, before reaching the fan housing 7.

In order that the cooking vapors F may be drawn in through the cavity 4, the cooktop 1 comprises an electric machine 12 which is configured to actuate the radial fan 7A, for example, by a mechanical coupling between the rotor of the electric machine 12 and the hub of the radial fan 7A.

For example, the electric machine 12 is embodied as a single electric motor.

Preferably, the cooktop 1 uses a single fan housing 7 (which is known to act as a volute for the first and second portions F1 and F2 and hence as a path for the gases toward the vapor vent pipe 9) having the radial fan 7A therein.

In an alternative embodiment, two opposed fans may be provided in the fan housing 7, which are both actuated by a single electric motor 12.

In a preferred embodiment, the diameter of the radial fan 7A is 185 mm and its rotation, imposed by the electric motor 12, may be as high as 2,700-3,000 revolutions/min.

As shown in the table below, these dimensional characteristics, as well as the separation of the cooking vapors F into first and second portions F1 and F2, will provide a better energy efficiency class and a higher fluid dynamic efficiency (FDE) index as compared with prior art cooktops.

In one aspect, also referring to FIG. 5, the electric machine 12 is at least partially accommodated in the first cooking vapor intake chamber 6.

Namely, one portion of the electric machine 12 is accommodated in the first cooking vapor intake chamber 6 and the rest is accommodated in the fan housing 7.

This is beneficial in that, as the motor is not entirely contained in the fan housing 7, i.e. part of it is external to the volume defined by the fan housing 7, there will be more space in the fan housing 7, and a greater amount of air may be drawn in, which will improve the performance of the cooktop 1.

In one aspect, also referring to FIG. 3, the electric machine 12 is mechanically, connected to the bottom 5A of the apparatus 5 for the electronics for stable connection of the electric machine 12.

It shall be noted that the control electronics for controlling the cooktop 1 are configured to supervise the operation of the heating elements and the operation of the devices required to draw in the cooking vapors F, i.e. the devices that form the extraction hood (the first and second cooking vapor intake chambers 6 and 8, the fan housing 7, the radial fan 7A, and the electric machine 12).

The cooktop 1 comprises a vapor vent pipe 9 which, in case of a simple extraction hood (i.e. with no additional filter elements), directly fits into the fan housing 7 and, in case of a filter hood, is coupled to the fan housing 7 with a filter block interposed therebetween, the latter being formed, for instance, with one or more charcoal-based filters (highly effective in removing odors from cooking vapors F).

It shall be noted that the fan housing 7, as shown in FIG. 3, defines a sidewall 7B that acts as a volute, and a bottom 71) having an intake grille 7E through which the second portion F2 of the cooking vapors flows.

The intake grille 7E also has such a design as to impart a regular pattern to the second vapor portion F2 for improved fluid dynamic performance.

In one aspect, the bottom 7D of the fan housing 7 and the bottom surface 1B of the cooktop 1, also referring to FIG. 5 define an inflow channel 10 for the second portion F2 of the cooking vapors.

The inflow channel 10 particularly extends between the bottom 4C of the cavity 4 and the bottom 71) of the fan housing 7 for the radial fan 7A. This inflow channel 10 actually forms the second cooking vapor intake chamber 8 and is placed upstream (as compared with the cooking vapor path for the second portion F2) from the fan housing 7.

Figure 4:
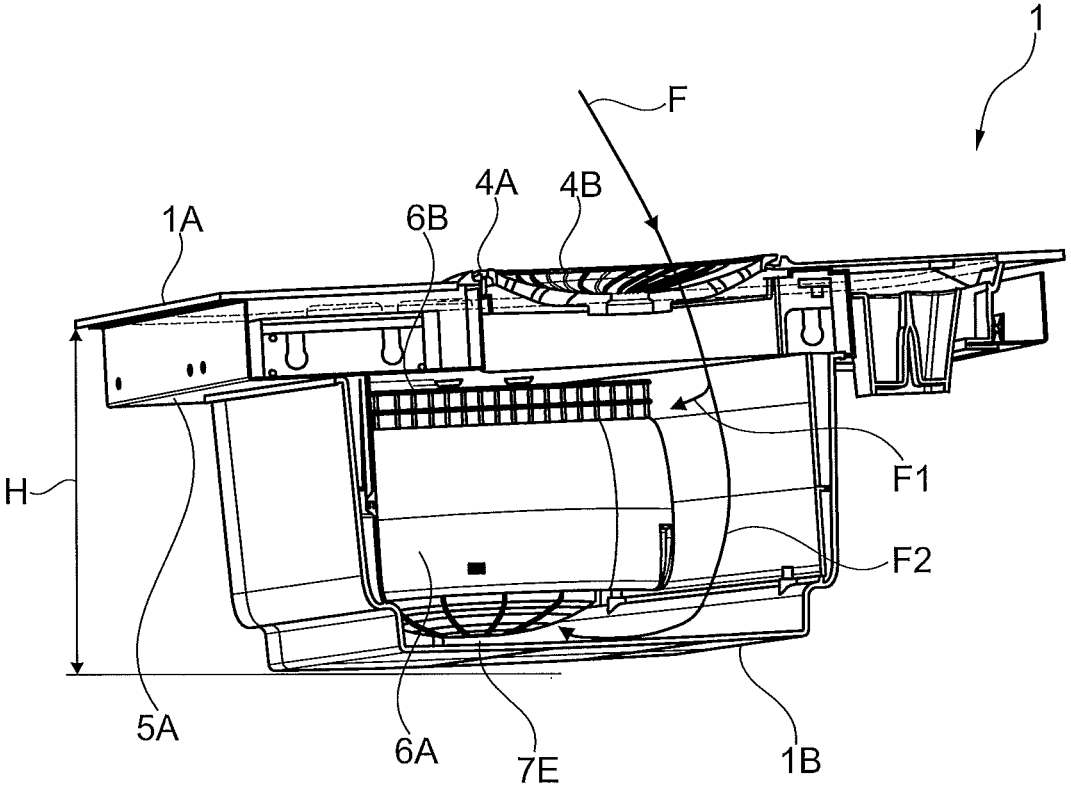
FIG. 4 shows a perspective sectional view of the hood of FIG. 1, with certain parts omitted to better show other parts.

The inflow channel 10 is configured for the second portion F2 of the cooking vapors to be directed outwards. This outward direction is substantially parallel to the top surface of the cooktop 1 (see FIG. 4).

It shall be further noted that the cavity 4 extends along a preset axial direction Y-Y, which is distinct from the vertical axis Y-Y' of the radial fan 7A or the electric machine 12.

In other words, the axis Y-Y of the cavity 4 is offset from the axis Y-Y' of the radial fan 7A or the electric machine 12.

In one aspect, it shall be noted that the inflow, channel 10 also acts as a collector for condensate, water, or other fluids.

Namely, the inflow channel 10 is so designed as to be able to contain a certain amount of fluids that will not be drawn in by the radial fan 7A, and hence will not affect the operation of the electric machine 12.

A hole shall be nevertheless provided on the bottom surface 1B, with a cap 1C for drainage of the fluids collected therein (see FIG. 3).

In order to assess the fulfillment of the intended objects, the Applicant compared the cooktop 1, in its extraction hood version, with the BORA® BFIA cooktop, having the features of the disclosure of WO 2012/146237.

Particularly, the BORA® BFIA cooktop is a cooktop with an integrated extraction hood, whose extraction components mainly include two motors, two volutes, a single downward-flowing vapor stream, which is divided into two streams within respective intake chambers only located proximate to the cooktop.

The results of this comparison are summarized in the following table:

| | BORA ® BFIA | "Cooktop 1" |
|---|---|---|
| Energy efficiency class | B | A+ |
| FDE class | B | A |
| FDE index | 23.1 | 38.1 |
| Static Pmax | 375 | 700 |
| Qmin $m^3/h$ | 194.8 | 212 |
| Qmin $m^3/h$ | 697.3 | 661 |
| dBAbost | 70 | 69 |
| GFE class | B | B |

It should be noted that the above tests have been conducted according to the international standard "*CEI IEC* 61591*: Household range hoods—Methods for measuring performance*".

It shall be further noted that the FDE index is the most representative parameter to assess the quality of the hood as it expresses the ratio of the work produced by the extraction unit (i.e., the fan housing 7 and the radial fan 7A in the case of the cooktop 1) to the power delivered by the electric machine 12 (i.e., the electric motor 12, in the case of the cooktop 1).

With the above in mind, as shown by the results in the table, the cooktop 1 has a considerably better energy efficiency class as compared with the BORA® BFIA cooktop. The energy efficiency class of the cooktop 1 is A+ and the energy energy efficiency class of BORA® BFIA is B.

This is both because the cooktop 1 uses a single motor instead of the two motors of the BORA® BFIA cooktop and especially because it has a better fluid dynamic behavior than BORA® BFIA.

It may be noted in this respect that the FDE index for the cooktop 1 is considerably better than that of BORA® BFIA and is about 65% higher than the FDE index that might be achieved with BORA® BFIA.

This advantage derives from the characteristic that the cooktop 1 has two distinct first and second cooking vapor intake chambers 6 and 8 (i.e., one located proximate to the inlet port 4A of the cavity 4 and the other located proximate to the bottom surface 1B of the cooktop 1) and, particularly, that the cooking vapor stream is divided into the first and second portions F1 and F2.

Namely, the first portion F1 is directed downwards toward the fan housing 7 of the radial fan 7A and the second portion F2 rises toward such fan housing 7.

Conversely, in the BORA® BFIA cooktop, there is a single cooking vapor stream, which is a vortex flow directed toward the bottom of the cooktop and divides into two streams, also forming vortices, before entering the respective fan housings.

Particularly, in the BORA® BFIA cooktop, the stream only divides because the cooking vapors impinge upon the cooktop and are separated in random fashion, i.e. with a lower efficiency as compared with the separation of the two streams obtained with the cooktop of the present disclosure.

It shall be further noted that the configuration of the cooktop 1 is advantageous as compared with the BORA® BFIA cooktop also in terms of maximum static pressure the ability of avoiding pressure losses).

Those skilled in the art will obviously appreciate that a number of changes and variants may be made to the arrangements as described hereinbefore to meet incidental and specific needs.

All of these variants and changes fall within scope of the disclosure, as defined in the following claims.

The invention claimed is:

1. A cooktop of predetermined width, length, and height, defining a top surface and an opposite bottom surface, comprising:

a plurality of cooking zones and a cavity in said top surface; and a device that forms a mounting unit with said top surface; for operating and controlling the cooktop and permitting vertical downward exhaust of cooking vapors into the cavity;

wherein said device comprises in order from said top surface:

an apparatus operably configured to hold heating elements that can heat said plurality of cooking zones and control and monitoring electronics for said cooktop, a first cooking vapor intake chamber in fluid communication with said cavity, a fan housing for a radial fan, a second cooking vapor intake chamber in fluid communication with said cavity, wherein said fan housing is in fluid communication with said first cooking vapor intake chamber and said second cooking vapor intake chamber, and said first cooking vapor intake chamber being configured to divide said cooking vapors into a first portion of the cooking vapors to be conveyed downwards into the fan housing and a second portion of the cooking vapors to be conveyed upwards into the fan housing through said second cooking vapor intake chamber.

2. The cooktop as claimed in claim 1, wherein said first cooking vapor intake chamber comprises a curved perimeter wall which acts as a conveyor for separating said cooking vapors into said first portion and said second portion.

3. The cooktop as claimed in claim 2, wherein said first cooking vapor intake chamber comprises an intake grille through which said first portion flows, said intake grille being placed proximate to said apparatus.

4. The cooktop as claimed in claim 1, comprising a vapor exhaust duct, wherein said fan housing is in direct communication with said vapor exhaust duct in an extraction configuration or through a filter unit in a filter configuration of said cooktop.

5. The cooktop as claimed in claim 1, wherein said fan housing has said fan installed therein and comprises a bottom having an intake grille through which said second portion of the cooking vapors flows, and a wall that acts as a volute.

6. The cooktop as claimed in claim 5, wherein said bottom of said fan housing defines, with said bottom surface, an inflow channel for the cooking vapors.

7. The cooktop as claimed in claim 1, comprising an electric machine configured to operate said radial fan, said electric machine being at least partially housed in said first cooking vapor intake chamber.

8. The cooktop as claimed in claim 7, wherein said electric machine is mechanically connected to a bottom of said apparatus.

9. The cooktop as claimed in claim 1, wherein said first and second portions of the cooking vapors are conveyed toward said first and second cooking vapor intake chambers respectively, in an outward direction parallel to said bottom surface of said cooktop.

10. The cooktop as claimed in claim 1, wherein said cavity extends in a preset vertical direction which is offset from an axis of rotation of said radial fan.

11. A cooktop having top and bottom surfaces, the cooktop comprising:

a plurality of cooking zones in the top surface, the top surface defining a cavity; and a device; forming a mounting unit with the top surface, for operating and controlling the cooktop and for permitting vertical downward exhaust of cooking vapors into the cavity;

wherein the device comprises, in order from the top surface:

an apparatus operably configured to hold elements for heating the cooking zones and electronics for controlling the cooktop;

a first cooking vapor intake chamber in fluid communication with the cavity;

a fan housing for a radial fan; and a second cooking vapor intake chamber in fluid communication with the cavity;

wherein the fan housing is in fluid communication with the first and second cooking vapor intake chambers, wherein the first cooking vapor intake chamber is configured to divide the cooking vapors into first and second portions, wherein the first portion is conveyed downward into the fan housing, and wherein the second portion is conveyed upward into the fan housing through the second cooking vapor intake chamber.

12. The cooktop of claim 11, wherein the first cooking vapor intake chamber comprises a curved perimeter wall that acts as a conveyor for separating the cooking vapors into the first portion and the second portion.

13. The cooktop of claim 11, wherein the first cooking vapor intake chamber comprises an intake grille through which the first portion flows, and wherein the intake grille is between the apparatus and the fan housing.

14. The cooktop of claim 11, further comprising:

a vapor exhaust duct;

wherein the fan housing is in:

direct communication with the vapor exhaust duct in an extraction configuration of the cooktop; or communication with the vapor exhaust duct through a filter unit in a filter configuration of the cooktop.

15. The cooktop of claim 11, wherein the radial fan is installed in the fan housing, and wherein the fan housing comprises:

a bottom having an intake grille through which the second portionflows; and a wall that acts as a volute.

16. The cooktop of claim 15, wherein the bottom of the fan housing defines, with the bottom surface, an inflow channel for the cooking vapors.

17. The cooktop of claim 11, further comprising:

an electric machine configured to operate the radial fan;

wherein the electric machine is at least partially housed in the first cooking vapor intake chamber.

18. The cooktop of claim 17, wherein the electric machine is mechanically connected to a bottom of the apparatus.

19. The cooktop of claim 11, wherein the first and second portions are conveyed toward the first and second cooking vapor intake chambers, respectively, in an outward direction parallel to the bottom surface of the cooktop.

20. The cooktop of claim 11, wherein the cavity extends in a vertical direction that is offset from an axis of rotation of the radial fan.

* * * * *